United States Patent [19]

Forshee

[11] 4,393,999

[45] Jul. 19, 1983

[54] CONVEYOR PALLET CONSTRUCTION

[75] Inventor: David J. Forshee, Oxford, Mich.

[73] Assignee: Syn-Trac Systems Inc., Oxford, Mich.

[21] Appl. No.: 220,798

[22] Filed: Dec. 29, 1980

[51] Int. Cl.[3] ..... B65D 19/32; B65D 19/44

[52] U.S. Cl. ..... 248/346; 108/55.3; 108/901

[58] Field of Search ..... 108/56.1, 55.1–55.5, 108/901, 51.1; 206/319, 386, 600; 248/346, 678

[56] References Cited

U.S. PATENT DOCUMENTS

| | | | |
|---|---|---|---|
| 3,212,807 | 10/1965 | Luchford et al. | 108/55.1 X |
| 3,667,403 | 6/1972 | Angelbeck, Jr. | 108/51.1 |
| 3,753,407 | 8/1973 | Tilseth | 108/55.5 X |
| 3,902,692 | 9/1975 | Skinner | 108/56.1 X |
| 3,971,314 | 7/1976 | Box | 108/51.1 X |
| 4,062,300 | 12/1977 | Real | 108/55.1 X |
| 4,183,491 | 1/1980 | Sanders et al. | 108/51.1 X |
| 4,189,125 | 2/1980 | Little | 248/346 |
| 4,212,446 | 7/1980 | Domanick et al. | 248/346 |

FOREIGN PATENT DOCUMENTS

| | | | |
|---|---|---|---|
| 619394 | 5/1961 | Canada | 108/51.1 |
| 1583763 | 2/1981 | United Kingdom | 206/599 |

*Primary Examiner*—William E. Lyddane

*Attorney, Agent, or Firm*—Benjamin W. Colman

[57] ABSTRACT

A pallet to support a component device for processing and testing, the device being removably secured to and upon the pallet for translation from a mounting station through one or more processing or assembly stations and optionally to a testing station, for elevation and lowering at the testing station, and for translation to a repair or discharge station, on conveyor devices moving the pallet by friction drives or other means. The pallet is made substantially entirely of a very tough nylon resin or equivalent plastic material. In one of its preferred forms the pallet comprises a grid body, an upper support plate member, a lower driven plate member and bumper bars on the side edges of the pallet. In a second preferred form the pallet comprises a grid body and an upper support plate member; and in a third form the pallet comprises a unitary molded grid body closed on its bottom side except for drain and bolt openings therethrough. The second preferred form of pallet can also be molded as a unitary device.

41 Claims, 14 Drawing Figures

CONVEYOR PALLET CONSTRUCTION

BACKGROUND OF THE INVENTION

The invention pertains to pallets carrying component devices for example such as a transmission housing, engine block, pump housing, transaxle housing or other device to which components are to be added and assembled, and the loaded pallets moved into and through testing stations. The conveyor system moving such pallets with the supported devices include roller conveyors, positive drive conveyors, or other similar translation means conventionally used in mechanical manufacturing facilities. The pallets of the prior art have been made of solid metal such as steel. To these are fixedly mounted, for securement of the component device being assembled and tested, a plurality of fixtures spaced apart from each other at intervals upon the top upper surface of the pallet. These fixtures removably engage and secure the component device to the pallet.

The steel pallets conventionally use plastic or resilient composition bumper bars on their side edges so that as the pallets move on the conveyors the shock and impact of contact with next preceding and following pallets are somewhat cushioned. Nevertheless, the steel pallet is substantially inflexible, being about 1½ inches in thickness, approximately 26 inches wide by about 34 inches long. These steel pallets weigh about 300–350 pounds each, and with the usual fixtures for mounting and securing an average-size transmission housing and assembly elements, the total unit can weigh well over 500 pounds. A man working at the production line conveyor system on which these pallets move, cannot lift such a pallet except by the aid of a mechanical hoist or lift truck. Therefore, removal of damaged units, be they pallets or the component devices carried thereon, significantly interferes time-wise with an orderly production line. The steel units do have one important advantage, namely that the dimensional change of the pallet is insignificant during its translation on the production line. Since the various stations for assembly and testing are predetermined, the length, width and thickness of the pallet and the related positioning of the component device therein being considered, dimensional changes in the pallet of any significant measure cannot be tolerated.

The principal disadvantages of the steel pallets are their excessive weight and difficulty in handling, even by mechanical means, as well as the time delays on a high-speed production line if and when the loaded pallet requires removal therefrom.

Another significant disadvantage, particularly at the present time, is the need for large quantities of energy in power and equipment to move such loaded heavy steel pallets from station to station in the line. Since the steel pallet performs primarily only a load bearing function, the reduction of weight in the pallet, while maintaining its dimensional stability, is a most desirable goal.

SUMMARY OF THE INVENTION

The invention disclosed herein comprises a plastic pallet, the principal elements of which are made of super tough nylon resin plastic or equivalent material having excellent dimensional stability and relative inflexibility. Where necessary or desirable, fiberglass can be added to the resin for greater strength. In one preferred form, the pallet is made of an upper plate member and a lower plate member fixedly secured to the upper and lower sides of an intermediate grid body, so that upon assembly pockets of air are formed within the body of the pallet. Securement of the upper and lower plate members to the grid body is preferably made by metal fasteners, such as bolts and nuts, or any other suitable means. Bumper bars for the side edges are mechanically attached by similar fasteners so that they can be removed with relative ease. Similarly, the fixtures removably mounted upon the upper plate member are made of the same or similar plastic material. The bottom plate member, where used, rides upon and is engaged by conveyor drive means, such for example as positive drive rollers which continually push, roll and translate the pallets from an initial position or station to a plurality of assembly stations where component elements are automatically and mechanically assembled to the component housing mounted on the pallet. These fixtures also include devices engagable by test equipment devices designed to elevate and lower the component-loaded pallet at a test station, such for example as a test station measuring the functional merit and determining the values of an automotive transmission unit.

Other forms of the pallet disclosed herein include a pallet comprising a grid body and a top plate member, or a grid body having its open pockets closed at the grid bottom plane except for drain openings and bolt hole recesses therethrough.

The weight of a plastic pallet with fixtures made according to the invention disclosed herein is roughly about one-fifth (1/5) the weight of the steel pallet with its steel fixtures thereon. Yet, the functional merit of the plastic pallet is at least comparable with and in many respects superior to that of the steel pallet. In addition, there are several other advantages.

For instance, there is a reduction of about 80% or more in the weight of the fixtured pallet. There is a significant elimination and reduction of maintenance of a plastic pallet as compared with the welding, straightening and other adjustments usually required to be made in maintaining steel pallets. A marked advantage is the elimination of heavy equipment to remove and replace steel pallets on a production line, for the plastic pallets, which weigh much less than 100 pounds, can be manually-lifted instead of equipment-lifted. The size of conveyor drive units to translate the plastic pallets can be significantly reduced on new assembly production lines. Less expensive rolls, reduced dimensionally and power-wise, can be utilized in the overall construction of such production lines. Because of this significant weight reduction, the plastic pallets are safer to use and handle. Plastic pallets can be color coded for different functional operations on the same production line. Although steel pallets can be painted on their exterior surfaces, they require repainting from time to time, whereas plastic pallets can have colors introduced throughout the body of the plastic, so that their coloration need never be periodically maintained. The entire electrical or hydraulic drive system, for a production line using the inventive plastic pallets, can be engineered for materially significant cost savings due to the very great reduction in the load carried and translated by the conveyor system. Replacement parts for the plastic pallet can be delivered much faster and with shorter down-time to repair the same. Where plastic pallets are used, they create less scrap components and assemblies, because these pallets will not scratch nor nick the component devices mounted thereon, when compared with the number of such defects occasioned by the use of steel pallets. Another advantage is that replacement details for the plastic pallet become stores' items, easily handled and supplied as needed.

The drive rollers of a conveyor on which these pallets will be used vary in width, depending upon the designer and the particular application for which the conveyor system is engineered. Thus, in some instances it may not be necessary to provide a bottom plate for the pallet, if the drive roller width and location in the conveyor system are such that these rollers will engage the bottom surfaces of grid body members and effectively translate the pallets from station to station. To accommodate varying widths of drive rollers, the bottom surface of the grid body members can be covered with a bottom plate, or be widened by means of lateral flanges extending to either side of the intermediate grid members and inwardly of the perimetric grid side members, or the pockets of the grid body can be closed at their bottoms with a layer of plastic material which is perforated with drain openings and recessed for the admission of bolts, nuts or other suitable fasteners.

DESCRIPTION OF THE PREFERRED EMBODIMENTS

Figure 1:
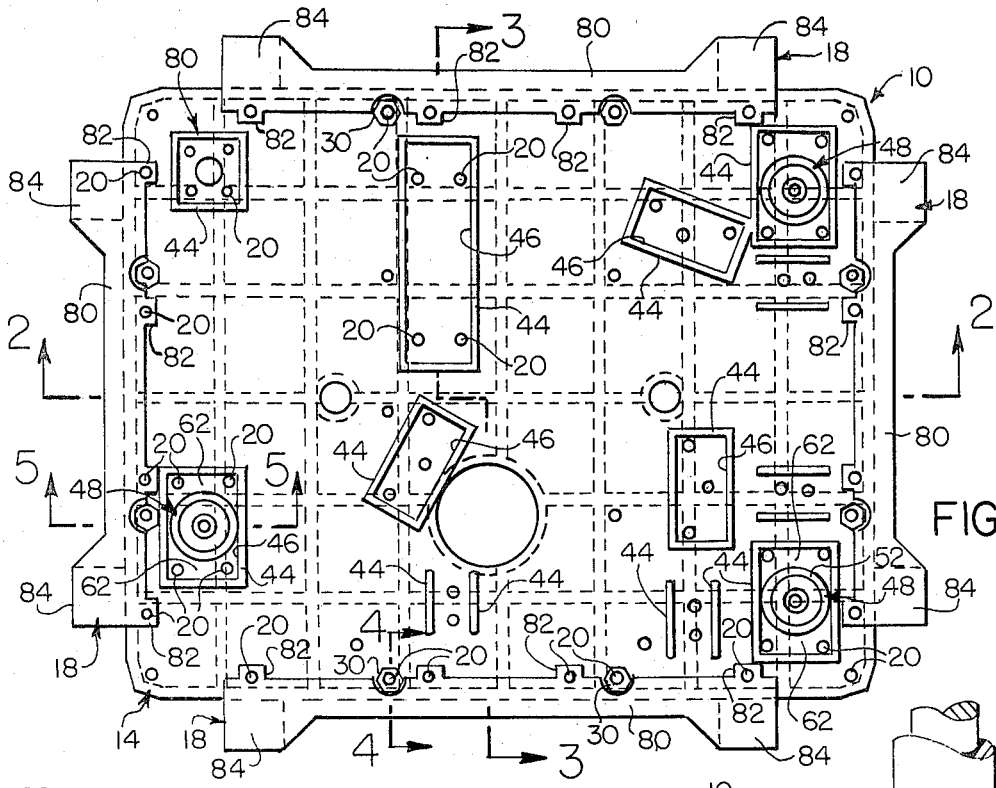
FIG. 1 is a top plan view of a preferred embodiment of the invention.
Figure 2:
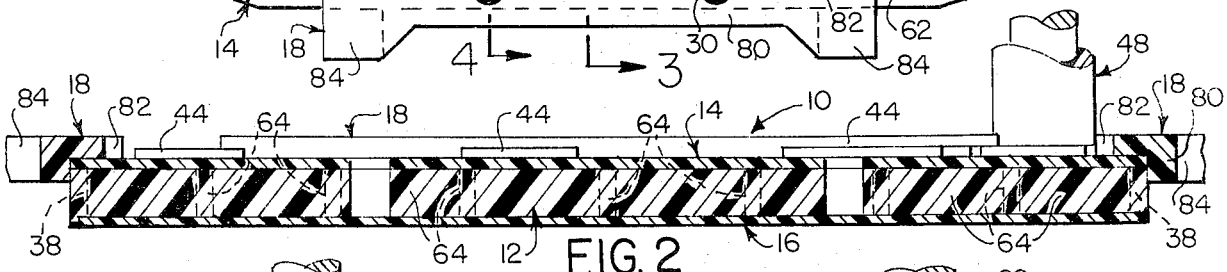
FIG. 2 is a longitudinal vertical sectional view taken substantially on the line 2—2 FIG. 1.
Figure 3:
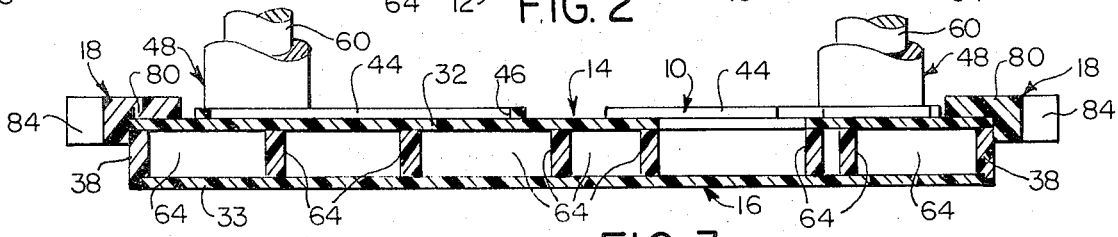
FIG. 3 is a transverse vertical sectional view taken substantially on the line 3—3 of FIG. 1.

As shown in several views of the drawings, one form of the pallet 10 comprises the grid body 12, the upper or top support plate 14, the lower bottom plate 16, and the side edge bumper bars or pads 18. The pallet 10 as illustrated and described herein constitutes one preferred embodiment of the invention. The pallets are preferably made of a high strength super tough nylon resin plastic material known by the tradename "Zytel ST", made by the E. I. duPont deNemours & Co., Inc., of Wilmington, Del. Other plastic materials having the equivalent or substantially equivalent physical, thermal and electrical properties and values may also be considered.

Figure 7:
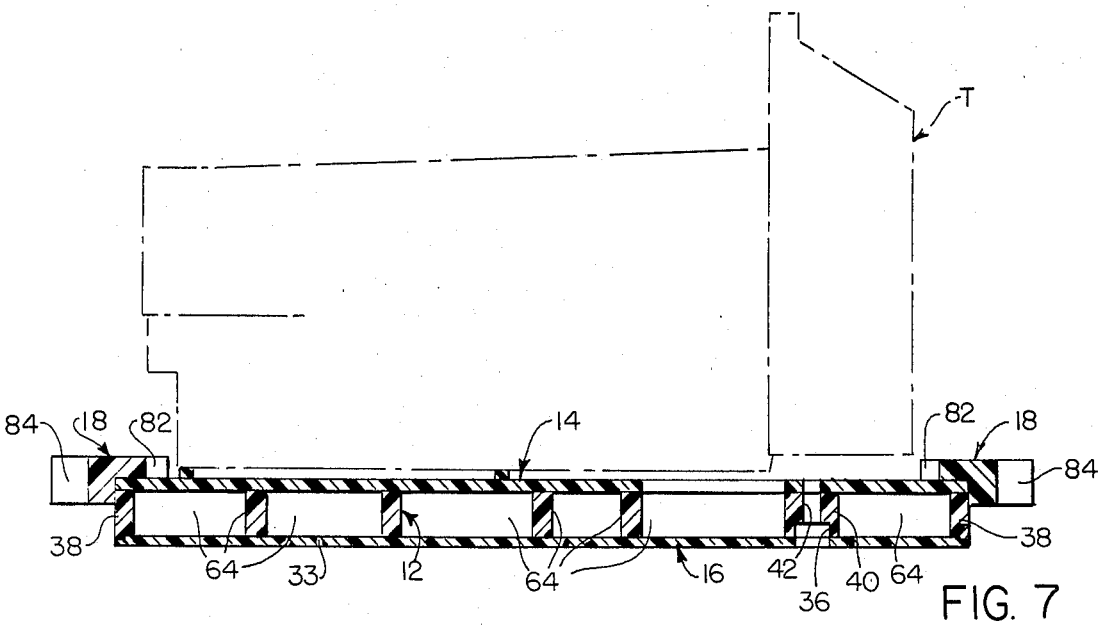
FIG. 7 is a vertical section view of the pallet illustrated in FIG. 1 showing a transmission housing in phantom line at rest on the plastic pallet.
Figure 8:
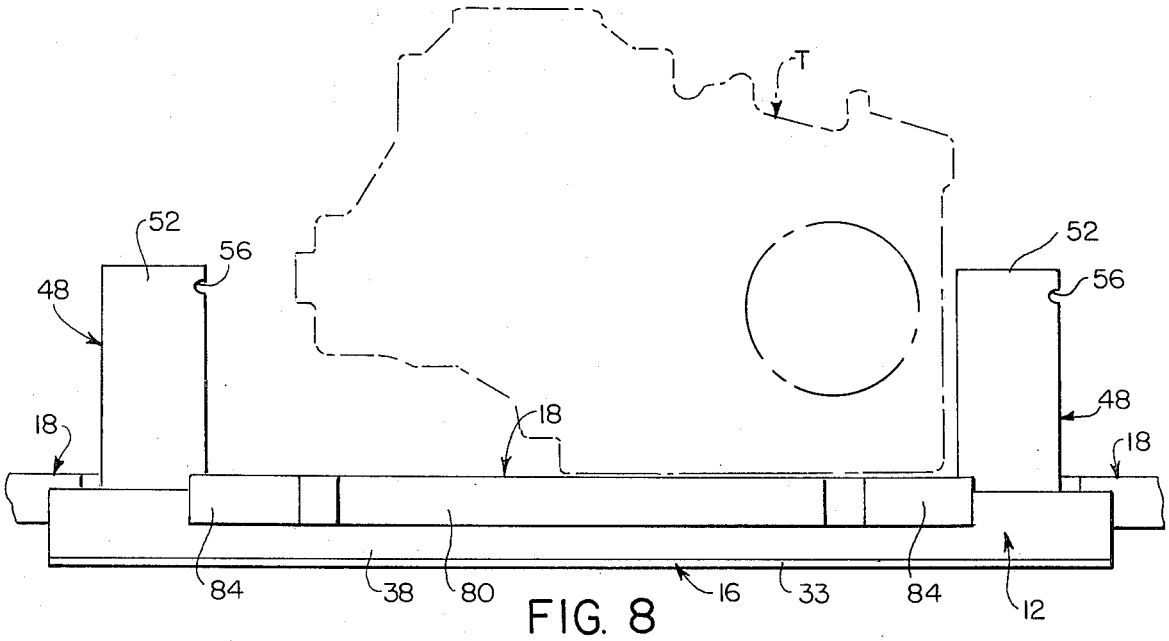
FIG. 8 is a side elevational view of the pallet and transmission device illustrated in FIG. 7.

Illustrated in broken lines in FIGS. 7 and 8 is an outline representation of a housing for a transmission unit carried by the pallet 10. Various elements are added manually or automatically to the housing as the pallet is moved from station to station for assembly into a transmission unit.

Figure 4:
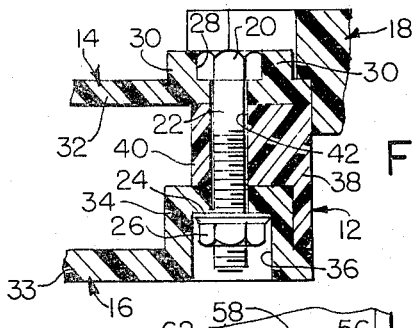
FIG. 4 is an enlarged fragmentary vertical sectional view taken substantially on the line 4—4 of FIG. 1.

The upper plate 14 and bottom plate 16 are secured together upon the intermediate grid body 12 by a plurality of fasteners 20 comprising a bolt 32, a washer 24, and a nut 26, all as shown substantially in FIG. 4. The nut 26 is preferably of the prevailing torque type of lock nut to reduce the possibility of inadvertent disengagement. The hex head of bolt 22 is seated in a counterbore recess 28 defined by an up-standing wall 30, the recess being preferably of hexagonal cross-sectional configuration to engage the bolt head and prevent the bolt from rotating when the nut 26 is advanced on its threaded shank. The body 32 of the top plate 14 provides a support for the bolt head. The body 33 of the bottom plate 16 is also provided with a plurality of complementary bosses for such fasteners. In the areas where fasteners are used, the bottom plate 16 is provided on its inner or upper side with a boss 34 having a counterbore recess 36 within which the washer 24 and nut 26 are positioned and threaded upon the shank of bolt 22. The inner diameter of the recess 36 is preferably large enough to accept the socket of a socket wrench for securing the nut 26 upon the bolt 22. The diameter of the hexagonal recess 28 may also be enlarged to accommodate the socket portion of a socket wrench for threading the bolt 22 upon the nut 26.

The exterior or side edge grid members 38 of the grid body 12 are provided on their inner surfaces with bosses 40 having bores 42 therethrough for passage of the threaded shank of bolt 22. The thickness of the top plate body 32 under the bolt head, the vertical dimension of the boss 40 and the thickness of the boss 34 above the fastener washer 24 are such that the overall vertical dimension of the pallet throughout is maintained substantially flat and planar. It is important for assembly and testing that the top plate upper surface and the bottom plate lower surface be flat, parallel and uniform throughout in thickness.

It is preferred to set the heads of the bolts 22 into hexagonal socket recesses 28 in order to prevent inadvertent disengagement or removal of the bolt from the pallet assembly. Such disengagement sometimes occurs in a production line due to constant shock and impact in the translation of pallets. When a transmission unit T is placed upon and secured to the pallet 10, the load is approximately 150 pounds or more, which increases the measure of concussion and impact to which the pallet is subjected.

Preferably molded into the upper surface of the body 32 of the top plate 14 are a plurality of up-standing flanges 44 which define cavities or recesses 46 within which fixtures for holding the transmission unit T during translation of the loaded pallet, or for handling and moving the pallet, are located and secured. The configuration and location of these fixtures will vary depending upon the dimensions, shape and configuration of the transmission unit T for which the pallets are designed.

Figure 5:
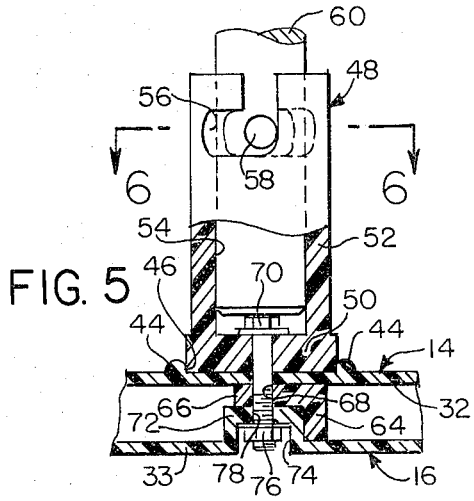
FIG. 5 is an enlarged fragmentary vertical sectional view, partly in elevation, taken substantially on the line 5—5 of FIG. 1.
Figure 6:
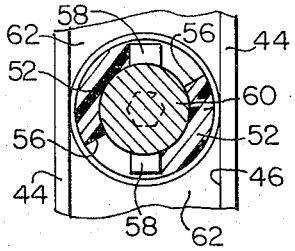
FIG. 6 is a horizontal sectional view taken substantially on the line 6—6 of FIG. 5.

If the pallets are to carry transmission units which go into and through testing stations, requiring the loaded pallet to be elevated and/or lowered, the pallet 10 is provided with tubular fixture devices 48, substantially as illustrated in FIGS. 1, 5 and 6. This fixture unit is also preferably made of the same type of plastic material used for the grid body and the top and bottom plates heretofore described. The pick-up unit 48 is molded with a base 50 having a configuration and dimensions complementary to the recess 46, the up-standing tubular portion 52 defining an interior counterbore 54, and a pair of diametrically opposed horizontal notches 56,56 adapted to receive the pins 58,58 extending laterally from and secured to the lift post 60 which is adapted to enter the counterbore 54 of the tubular portion or sleeve 52. The outer flanges 62,62 of the pick-up fixture 48 are secured by fasteners 20 to the body 32 of the top plate 14, as shown substantially in FIG. 5. The intermediate grid member 64 is provided with a boss 66 having a bore 68 to pass the shank of a hold-down bolt 70 through. The body 33 of the bottom plate 16 is provided with an interior boss 72 which is counterbored externally to provide a recess 74 within which a nut 76 is threaded onto the end of bolt 70, the shank of which passes through an opening 78 in the boss. The base 50 of the pick-up fixture 48 is suitably bored to receive and pass the shank of bolt 70, as is the body 32 of the top plate 14, as shown in FIG. 5.

As illustrated particularly in FIG. 1, the pallet 10 is arranged for and provided with a plurality of pick-up fixtures 48, generally positioned adjacent corners of the pallet. Three of these devices 48 are shown in the plan view of FIG. 1, the fourth corner being provided with an indexing device 80 actuated by mechanisms affixed to and upon the conveyor system of the production line.

Figure 9:
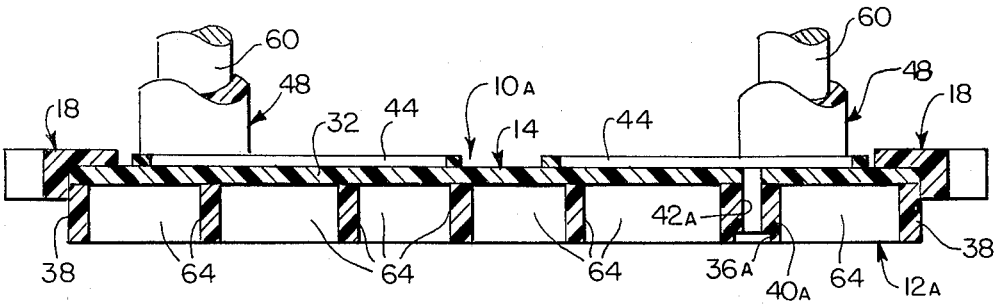
FIG. 9 is a transverse vertical sectional view, similar to FIG. 3, showing a modified form of the pallet, the bottom plate having been eliminated.
Figure 10:
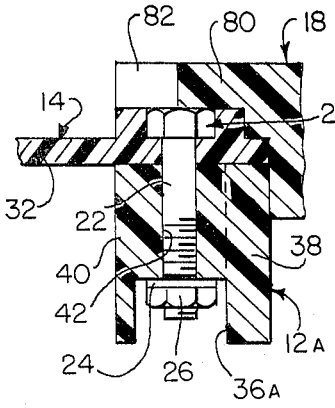
FIG. 10 is an enlarged fragmentary vertical sectional view, similar to FIG. 4, showing an attachment of the top plate and the grid body at the lateral edge of the pallet, for the pallet construction illustrated in FIG. 9.

The bumper bars 18 comprise a body portion 80 secured by fasteners 20 upon and to the top plate 14, intermediate grid body 12 and bottom plate 16 by fasteners 20, similar to the arrangement shown in FIG. 4. To secure the bumper bar 18, the bolts 22 pass through holes in the body 80 in the four positions at the lugs 82 shown at the rearward edge of the bumper bar. The body of the bumper bar is preferably provided with a pair of lateral end bumper pads 84,84 projecting forwardly and outwardly from the body portion 80. These pads are the first elements to engage adjacent pallets or triggering mechanisms designed to actuate movement of the loaded pallet from station to station. The bumper bars also provide means for effectively absorbing shock and impact stresses in the translation of the loaded pallets when adjacent pallets or blocking obstacles are contacted. The bumper bars 18 are preferably made of the same type of super tough nylon resin material as are the top and bottom plates and the intermediate grid body of the pallet 10. The bumper bars may be formed integrally with the grid body, or separately therefrom as shown and described.

Where no bottom plate is used, the pallet **10*a* comprising the top plate 14 and grid body 12*a* is assembled substantially as shown in FIGS. 9 and 10. The grid body side member 38, or any intermediate grid member 64 is provided with a boss 40 having a bore 42 extending vertically through the boss to receive the shank of a fastener bolt 22 threadedly engaged with a nut 26 which is seated in the counterbored recess 36*a*. The same or a similar boss-type construction and assembly is used where fasteners are applied at or adjacent intermediate grid body members 64 to secure a fixture or the bumper bars 18 to the top plate and grid body assembly 10*a***.

Figure 11:
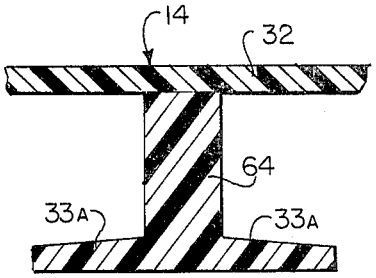
FIG. 11 is an enlarged fragmentary vertical sectional view showing a modified base for grid members of a pallet construction where no bottom plate is used.

A slightly modified form of the grid body construction **12*a* is illustrated in the fragmentary view, FIG. 11. Lateral flanges 33*a* are integrally formed at and extend outwardly from the base of the intermediate grid body members 64. For the side members 38, similar flanges 33*a* may extend outwardly from these members at their distal edges, i.e. from one side thereof, or optionally, both inwardly and outwardly from each side thereof. By the use of such flanges, varying widths of drive rollers can be accommodated and accepted without requiring a separate bottom plate 16, as above described for the pallet 10. Another feature of the flanges 33*a*** is that their upper surfaces can be tapered downwardly toward their distal edges to permit the free flow of liquids, such as lubricant oils and other similar material, from the pallet. These liquids impinge upon the pallet surfaces as component devices are assembled and tested in translation along the conveyor production line from station to station.

Figure 12:
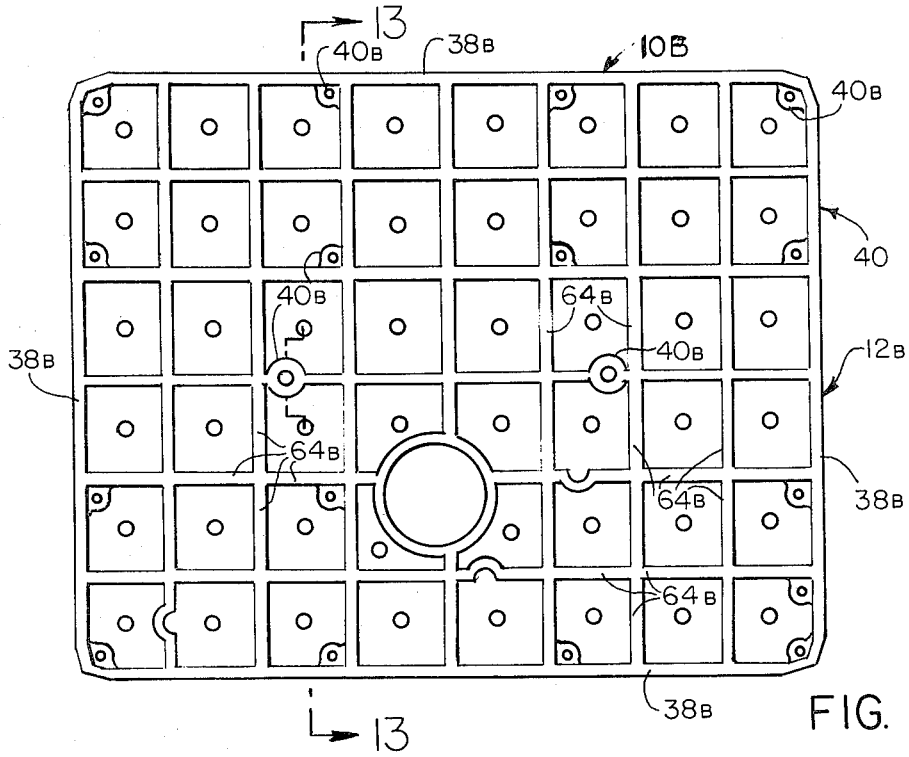
FIG. 12 is a top plan view of another modified form of pallet with an open top and a closed bottom except for oil drain and bolt openings, molded as a unit.
Figure 13:
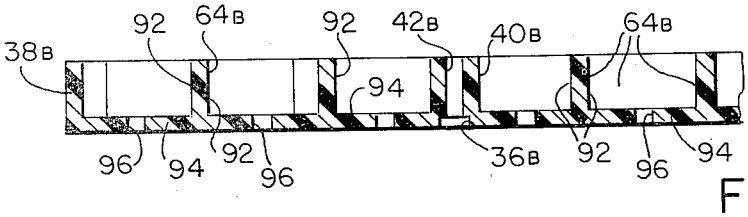
FIG. 13 is a transverse vertical sectional view taken substantially on the line 13—13 of FIG. 12.
Figure 14:
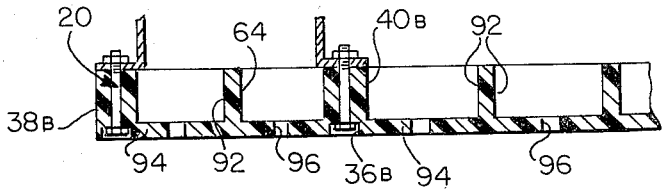
FIG. 14 is a fragmentary vertical sectional view similar to FIG. 13 showing portions of a fixture secured by bolts to the pallet illustrated in FIG. 12.

The one-piece pallet **10*b*, illustrated in FIGS. 12, 13 and 14, comprises the grid body 12*b* having grid members 64*b* arranged intermediate the perimetric side edge numbers 38*b* in a substantially egg-crate pattern. Bosses 40*b* are provided with bolt openings 42*b* and recesses 36*b* for the admission of threaded bolt shanks 22 and nuts 26 (or bolt heads) respectively to secure the fixtures holding a component device, such for example as the transmission unit T, to the pallet. The bottom of each grid pocket 92 is closed by a bottom panel 94 which is perforated with a drain opening 96**.

Just as the pallet **10*b* can be molded as a unitary device, so can the pallet 10*a*, which is substantially the inverse of pallet 10*b*. However, if the grid body members 64*a* and 38*a* terminate at their distal edges with flanges 33*a*, the pallet 10*a* is preferably molded in two separate pieces, i.e. the top plate member 14 and the lower grid body 12*a***, which are then conjoined by suitable fasteners and/or adhesives to form the pallet.

Although the pallets 10 and **10*a* have been illustrated and described as having fixture locating flanges 44** on their upper surfaces, it is to be understood that such flanges may not be necessary if the fixtures are dowelled into the pallet grid body. In such construction the upper surface of these pallets would be substantially planar.

Each of the principal elements of the pallets 10, **10*a* and 10*b* is preferably made by molding the nylon resin material into the desired and required configuration. The Zytel ST material is a moldable nylon resin to which, if necessary or desired, fiberglass filaments or equivalent strengthening materials can be added. Certain of the transmission unit support fixtures, not shown nor described because they vary in configuration and dimension as well as in location upon the pallet, depending upon the shape and configuration of the transmission unit or other component housing carried by the pallet, are preferably molded of the super tough nylon resin material substantially to its finished dimensions. By molding the up-standing flanges 44 into the upper surface of the top plate 14**, location problems for the fixtures can be and are eliminated.

Although certain particular embodiments of the invention have been disclosed herein for purposes of explanation, further modifications or variations thereof, after study of this specification, will or may become apparent to persons skilled in the art to which the invention pertains. Reference should be had to the appended claims in determining the scope of the invention.

I claim:

1. In a conveyor driven plastic pallet structure for supporting and translating a device to be processed, assembled and/or tested, the improved combination comprising a top plate, an intermediate grid body and a bottom plate arranged in lamella relationship, said grid body having a plurality of spaced apart intermediate grid members defining open pockets or spaces therebetween and lateral side members defining the perimeter of said grid body, one or more upstanding fixture devices secured to and upon the upper surface of said top plate for selective engagement and attachment by and to, and disengagement and detachment from a processing, assembling and/or testing machine, and for elevating and lowering said pallet for one or more processing, assembling and/or testing operations on said device supported on and translated by said pallet, and means fixedly securing said fixture devices to said top plate surface, and securing said top plate, grid body and bottom plate together.

2. The pallet combination defined in claim 1, wherein each said top plate, grid body and bottom plate is integrally formed.

3. The pallet combination defined in claim 1, wherein said top plate and said bottom plate each have perimeters substantially coincident with the perimeter of said grid body.

4. The pallet combination defined in claim 1, wherein said securing means comprises a plurality of threaded bolt and nut type fasteners.

5. The pallet combination defined in claim 4, wherein said top plate upper surface is provided with upstanding flanges defining recesses or cavities conforming to the heads of said fastener bolts, said flanges engaging said bolt heads to prevent rotation thereof when seated in said recesses.

6. The pallet combination defined in claim 4, wherein said grid body side members and selected said grid body intermediate members are provided with laterally directed bosses having upper surfaces disposed contiguously with the inner or lower surface of said top plate and lower surfaces disposed contiguously with the inner or upper surface of said bottom plate.

7. The pallet combination defined in claim 6, wherein said fasteners secure said top plate, grid body and bottom plate together transversely therethrough at said bosses.

8. The pallet combination defined in claim 6, wherein said bottom plate is provided on its inner or upper surface with a plurality of elevated bosses having upper surfaces disposed contiguously with said grid body bosses' lower surfaces, said bottom plate bosses being counterbored on their lower outer surfaces to provide recesses for said fastener nuts, whereby said bottom plate lower surface is flat and planar.

9. The pallet combination defined in claim 1, wherein the upper and lower surfaces of said grid body lie in flat parallel planes.

10. The pallet combination defined in claim 9, wherein the plane of said top plate upper surface and the plane of said bottom plate lower surface are flat and parallel.

11. The pallet combination defined in claim 1, wherein said grid body comprises a plurality of grid members forming a plurality of substantially rectangular open-ended pockets extending transversely of said grid body from said top plate to said bottom plate.

12. The pallet combination defined in claim 1, including a resilient plastic bumper bar secured to and upon the upper surface of said combination at the lateral edges thereof for cushioning the shock and impact of pallet-to-pallet contact upon translation.

13. The pallet combination defined in claim 12, wherein each said bumper bar comprises a body and a bumper pad at each lateral end thereof projecting outwardly and forwardly therefrom.

14. The pallet combination defined in claim 1, wherein said top plate, intermediate grid body and bottom plate are each fabricated of a high strength dimensionally stable nylon resin plastic material.

15. The pallet combination defined in claim 1, wherein said top plate is provided on its upper surface intermediate the end and side edges thereof with a plurality of upstanding flanges defining recesses therebetween for locating fixture devices adapted to be secured to said pallet for securing components of said device to be processed, assembled and/or tested thereon.

16. In a conveyor driven plastic pallet structure for supporting and translating a device to be processed, assembled and/or tested, the improved combination comprising a top plate and a grid body arranged in lamella relationship, said grid body having a plurality of spaced apart intermediate grid members defining open pockets or spaces therebetween and lateral side members defining the perimeter of said grid body, one or more upstanding fixture devices secured to and upon the upper surface of said top plate for selective engagement and attachment by and to, and disengagement and detachment from a processing, assembling and/or testing machine, and for elevating and lowering said pallet for one or more processing, assembling and/or testing operations on said device supported on and translated by said pallet, and means fixedly securing said fixture devices to said top plate surface, and securing said top plate and grid body together.

17. The pallet combination defined in claim 16, wherein each said top plate and grid body is integrally formed.

18. The pallet combination defined in claim 16, wherein said top plate has a perimeter substantially coincident with the perimeter of said grid body.

19. The pallet combination defined in claim 16, wherein said securing means comprises a plurality of threaded bolt and nut type fasteners.

20. The pallet combination defined in claim 16, wherein
the upper and lower surfaces of said grid body lie in flat parallel planes.

21. The pallet combination defined in claim 19, wherein
said top plate upper surface is provided with upstanding flanges defining recesses or cavities conforming to the heads of said fastener bolts, said flanges engaging said bolt heads to prevent rotation thereof when seated in said recesses.

22. The pallet combination defined in claim 19, wherein
said grid body side members and selected said grid body intermediate members are provided with laterally directed bosses having upper surfaces disposed contiguously with the inner or lower surface of said top plate.

23. The pallet combination defined in claim 22, wherein
said fasteners secure said top plate and grid body together transversely therethrough at said bosses.

24. The pallet combination defined in claim 20, wherein
the plane of said top plate upper surface and the plane of said grid body lower surface are flat and parallel.

25. The pallet combination defined in claim 16, wherein
said grid body comprises a plurality of grid members forming a plurality of substantially rectangular open-ended pockets extending transversely of said grid body.

26. The pallet combination defined in claim 16, including
a resilient plastic bumper bar secured to and upon the upper surface of said combination at the lateral edges thereof for cushioning the shock and impact of pallet-to-pallet contact upon translation.

27. The pallet combination defined in claim 26, wherein
each said bumper bar comprises a body and a bumper pad at each lateral end thereof projecting outwardly and forwardly of said lateral edges.

28. The pallet combination defined in claim 16, wherein
said top plate and grid body are each fabricated of a high-strength dimensionally stable nylon resin plastic material.

29. The pallet combination defined in claim 16, wherein
said grid body side and intermediate members are provided at their bases with laterally extending flanges.

30. The pallet combination defined in claim 29, wherein
the upper surfaces of said laterally extending flanges taper downwardly from their respective adjoining grid body side and intermediate members to their distal edges.

31. The pallet combination defined in claim 16, wherein
said top plate is provided on its upper surface intermediate the end and side edges thereof with a plurality of upstanding flanges defining recesses therebetween for locating fixture devices adapted to be secured to said pallet for securing components of said device to be processed, assembled and/or tested thereon.

32. In a conveyor driven plastic pallet structure for supporting and translating a device to be processed, assembled and/or tested, the improved construction comprising
a grid body having
a plurality of spaced apart intermediate grid members defining open pockets or spaces therebetween and lateral side members defining the perimeter of said grid body and a panel defining the bottom of each said pocket, said bottom panels having openings transversely therethrough to provide an outlet from said pockets for liquids or other matter which may collect in said pockets,
and one or more upstanding fixture devices secured to and upon the upper surface of said grid body for selective engagement and attachment by and to, and disengagement and detachment from a processing, assembling and/or testing machine, and for elevating and lowering said pallet for one or more processing, assembling and/or testing operations on said device supported on and translated by said pallet,
and means fixedly securing said fixture devices to said grid body upper surface.

33. The pallet construction defined in claim 32, wherein
said bottom panels lie in a plane defining the bottom surface of said grid body.

34. The pallet construction defined in claim 32, wherein
said grid body is integrally formed.

35. The pallet construction defined in claim 32, wherein
the upper and lower surfaces of said grid body lie in flat parallel planes.

36. The pallet construction defined in claim 32, wherein
said grid members form a plurality of substantially rectangular pockets open at their upper ends and extending transversely of said grid body from said bottom panels.

37. The pallet construction defined in claim 32, wherein
said grid body side members and selected grid body intermediate members are provided with laterally directed bosses having upper surfaces disposed substantially in the plane of the upper surface of said grid body and lower surfaces disposed substantially in the plane of the lower surface of said bottom panels.

38. The pallet construction defined in claim 37, wherein
said grid body bosses are counterbored on their lower outer surfaces to provide recesses for fastener elements, whereby said grid body lower surface is flat and planar.

39. The pallet construction defined in claim 32, including
a resilient plastic bumper bar secured to and upon the upper surface of said grid body at the lateral edges thereof for cushioning the shock and impact of pallet-to-pallet contact upon translation.

40. The pallet construction defined in claim 39, wherein
each said bumper bar comprises a body and a bumper pad at each lateral end thereof projecting outwardly and forwardly therefrom.

41. The pallet construction defined in claim 32, wherein
said grid body is fabricated of a high strength dimensionally stable nylon resin plastic material.

* * * * *